US005087219A

United States Patent [19]

Price

[11] Patent Number: 5,087,219

[45] Date of Patent: Feb. 11, 1992

[54] ACTION CHARACTER FIGURE

[75] Inventor: Daniel W. Price, Chepachet, R.I.

[73] Assignee: Hasbro, Inc., Pawtucket, R.I.

[21] Appl. No.: 669,857

[22] Filed: Mar. 15, 1991

[51] Int. Cl.[5] ..... A63H 13/02; A63H 13/06; A63H 13/00; A63H 3/36

[52] U.S. Cl. ..... 446/336; 446/334; 446/354; 446/320

[58] Field of Search ..... 446/336, 335, 334, 333, 446/330, 352, 353, 354, 358, 320

[56] References Cited

U.S. PATENT DOCUMENTS

| | | | |
|---|---|---|---|
| 653,127 | 7/1900 | Wale, Jr. | 446/333 |
| 1,329,958 | 2/1920 | Criest | 446/333 |
| 1,633,456 | 6/1927 | Norberg | 446/333 |
| 2,506,190 | 5/1950 | Barnes | 124/1 |
| 3,906,661 | 9/1975 | Weiser | 446/336 X |
| 4,085,540 | 4/1978 | Jernstrom et al. | 446/333 |
| 4,118,888 | 10/1978 | Ogawa | 446/92 |
| 4,515,371 | 5/1985 | Basevi | 446/336 X |
| 4,579,542 | 4/1986 | Mayer et al. | 446/330 |
| 4,605,382 | 8/1986 | Cook et al. | 446/334 X |
| 4,608,026 | 8/1986 | Newton et al. | 446/334 X |
| 4,674,989 | 6/1987 | Bovi et al. | 446/336 |

FOREIGN PATENT DOCUMENTS

| | | | |
|---|---|---|---|
| 1249158 | 10/1971 | United Kingdom | 446/333 |
| 1263186 | 2/1972 | United Kingdom | 446/333 |
| 2199761 | 7/1988 | United Kingdom | 446/320 |

*Primary Examiner*—David N. Muir
*Attorney, Agent, or Firm*—Salter & Michaelson

[57] ABSTRACT

An action character figure includes a torso portion, a rotatable arm portion on the torso portion, and a leg portion which is retractable into the lower end of the torso portion. The arm portion is connected to the leg portion in the interior of the torso portion such that rotation of the arm portion causes the leg portion to be retracted into the torso portion against the force of an internal biasing spring, and such that thereafter releasing the arm portion causes the arm portion to be rotated in a reverse direction and the leg portion to be resiliently propelled toward a normal outwardly extended position.

7 Claims, 4 Drawing Sheets

ACTION CHARACTER FIGURE

BACKGROUND AND SUMMARY OF THE INVENTION

The instant invention relates to action character figures and more particularly to an action character figure which is adapted to perform a predetermined wrestling maneuver.

The popularity of professional wrestling has increased significantly in recent years among children as well as among persons of various other age groups. In this regard, it has been found that the popularity of professional wrestling is at least partially a result of both the flamboyant nature of many professional wrestlers and some of the specific wrestling maneuvers which they frequently perform. However, while the popularity of professional wrestling with children has increased significantly in recent years until recently the toy industry has failed to provide action character figures which are capable of performing or simulating many of the types of wrestling maneuvers commonly performed by certain professional wrestlers. Hence, while children have frequently been found to gain significant enjoyment from watching the performances of professional wrestlers, until recently they have not been able to effectively incorporate wrestler characters into their imaginary play themes.

The instant invention provides an effective and relatively simple action character figure which is capable of performing a predetermined wrestling maneuver. More specifically, the instant invention provides an effective action character figure which can be alternatively embodied in a configuration which is capable of performing a footstomping action or in a configuration which is capable of performing a drop-kick action, and in either case it is simultaneously operative for performing an overhead punching action. Specifically, the action character figure of the instant invention comprises a torso portion, an arm portion mounted on the torso portion so that it is rotatable about a substantially horizontal axis when the torso portion is an upright disposition, a leg portion and a leg portion mounting assembly which is operative for mounting the leg portion on the torso portion so that it is movable between a normal or extended position and a retracted position wherein the leg portion is at least partially retracted upwardly into the torso portion. The character figure further includes a biasing means biasing the leg portion toward the extended position thereof and a connecting mechanism for interconnecting the arm portion with the leg portion so that manual rotation of the arm portion in a predetermined direction causes the leg portion to be retracted from the normal position thereof toward the retracted position thereof. The biasing means and the connecting mechanism are preferably adapted so that when the arm portion is rotated to retract the leg portion into the body portion and the arm portion is thereafter released, the leg portion is rapidly propelled downwardly toward the normal position thereof by the biasing means while the arm portion is rapidly rotated in a reverse direction to simulate a punching action. In one embodiment of the action character figure the leg portion comprises a pair of legs which are adapted to move together between the retracted and normal positions thereof to simulate a drop-kick action. In this embodiment, the arm portion preferably comprises a single arm which is connected to the leg portion so that the arm portion is rotated as the leg portion is moved between the normal and retracted positions thereof. In a second embodiment of the action character figure the leg portion defines a single leg and the character figure further comprises a second leg which is attached to the lower end of the torso portion. In this embodiment the arm portion preferably also comprises a single arm which is rotatable for moving the leg portion between the normal and retracted positions thereof. Accordingly, this embodiment of the action character figure is adapted for performing a stomping action wherein one leg of the character figure is advanced rapidly downwardly while one arm of the character figure is rotated to simulate a punching action.

It has been found that the action character figure of the instant invention can be effectively utilized by children in play activities having wrestling themes for simulating the actions of various professional wrestlers. Specifically, it has been found that the first embodiment of the character figure can be effectively utilized for simulating a dropkick action with a simultaneous punching action and that the second embodiment can be effectively utilized for simulating a stomping action with a simultaneous punching action. As a result, the action character figure of the subject invention has been found to have a high level of play value and that it is capable of providing substantial amusement to children.

The closest prior art to the subject invention of which the applicant is aware is disclosed in the patents to Wale, Jr. U.S. Pat. No. 653,127; Norberg U.S. Pat. No. 1,633,456; Barnes U.S. Pat. No. 2,506,190; and Ogawa U.S. Pat. No. 4,118,888. However, while these references teach a variety of action character figures they fail to suggest an action character figure wherein a retractable leg portion is internally connected to a rotatable arm portion in the manner of the action character figure of the subject invention, and hence they are believed to be of only general interest with respect thereto.

Accordingly, it is a primary object of the instant invention to provide an effective action character figure which is capable of performing a realistic wrestling maneuver.

Another object of the instant invention is to provide an action character figure which is capable of performing a stomping action.

Another object of the instant invention is to provide an action character figure which is capable of performing a drop-kick action.

An even still further object of the instant invention is to provide an action character figure comprising a torso portion, and an outwardly biased leg portion which is retractable into the torso portion, and an arm portion which is rotatable for retracting the leg portion into the torso portion so that the leg portion is propelled outwardly to a normal position when the arm portion is released.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
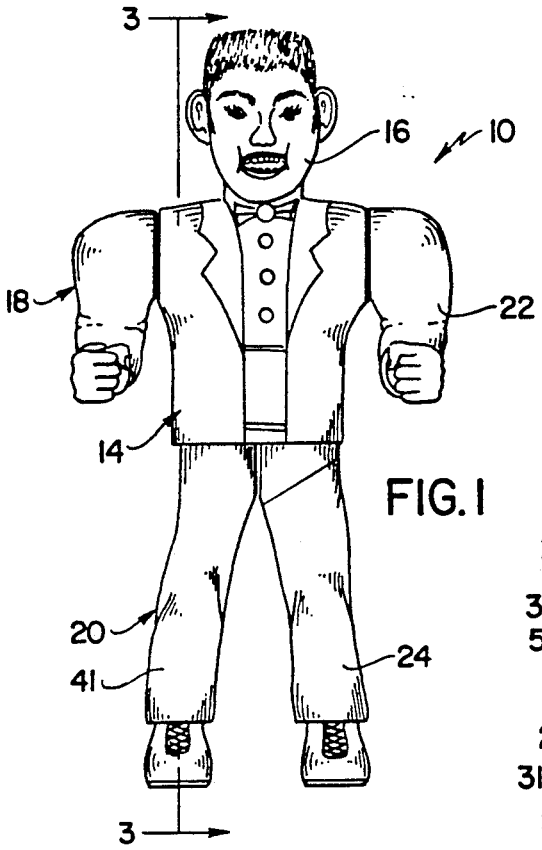
FIG. 1 is a front elevational view of a first embodiment of the action character figure of the instant invention.
Figure 3:
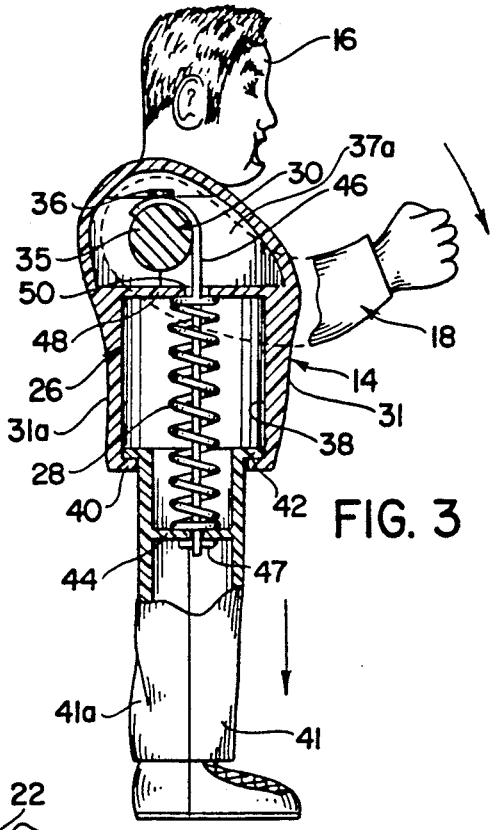
FIGS. 2 and 3 are sequential side-elevational views thereof in partial section illustrating the operation of the first embodiment of the character figure.

Referring now to the drawings, a first embodiment of the action character figure of the instant invention is illustrated in FIGS. 1 through 4 and generally indicated at 10, and a second embodiment of the action character figure is illustrated in FIGS. 5 through 8 and generally indicated at 12. The action character FIG. 10 is adapted for performing a foot-stomping action wherein a leg thereof is rapidly propelled downwardly from a retracted position in the torso as the right arm of the character FIG. 10 is rotated forwardly and downwardly. The action character FIG. 12 on the other hand, is operative for performing a drop-kick action wherein both legs thereof are rapidly propelled downwardly from a retracted position in the torso portion thereof as the right arm of the character FIG. 12 is rotated forwardly and downwardly.

Referring first to FIGS. 1 through 4, the action character FIG. 10 comprises a torso portion generally indicated at 14 having a head 16 thereon, an arm portion generally indicated at 18 on the torso portion 14 and a leg portion generally indicated at 20. The arm portion 18 defines a first or right arm of the character FIG. 10, and the character FIG. 10 further includes a left or second arm 22. The leg portion 20 defines a first or right leg of the character FIG. 10, and the character FIG. 10 also includes a left or second leg 24. The character FIG. 10 further includes a leg portion mounting assembly generally indicated at 26, a biasing spring 28, and a connecting assembly generally indicated at 30. The torso portion 14 is formed in the configuration of a human torso, and it includes front and rear halves 31 and 31*a*, respectively, and the left arm 22 which is formed in the configuration of a human arm is rotatably mounted on the torso portion 14 by means of a conventional rotatable inner disk 32 which is integrally formed on the left arm 22. The second or left leg 24 is formed in the configuration of a human leg, and it is similarly mounted on the torso portion 14 at the lower end thereof by means of an integrally formed rotatable disk 33. The first or right arm 18, which is also formed in the configuration of a human arm, is rotatably mounted on the torso portion 14 by means of a shaft 34 having a circular disk 34*a* thereon, and a hex shaft 34*b* extends inwardly into the torso portion 14 from the disk 34*a*. An internal shaft 35 having a pin 36 thereon and having a slotted hex socket 37 at one end thereof is received in the interior of the torso portion 14, and the hex shaft 34*b* is received in the hex socket 37 so that the shaft 34*b* is rotatable in the socket 37 to prevent breakage in the event that an excessive rotational force is applied to the arm 18. A pair of notched vertical walls 37*a* are formed in the rear torso half 31*a*, and a pair of similar notched vertical walls 37*a* are formed in the front torso half 31 for rotatably mounting the shaft 35 in the torso portion 14.

The mounting assembly 26 includes an inner chamber 38 which is integrally formed in the interior of the torso portion 14, the chamber 38 extending upwardly in the interior of the torso portion 14 from the lower end thereof and including a reduced mouth 40. The mounting assembly 26 also includes a flange 42 on the upper end of the leg portion 20 for retaining the leg portion 20 on the torso portion 14. In this connection, the leg portion 20 comprises front and rear sections 41 and 41*a*, respectively, and it is of substantially uniform cross-section, so that it is retractable upwardly into the interior of the torso 7 portion 14 for retracting the flange 42 and the upper portion of the leg portion 20 upwardly into the chamber 38.

Figure 2:
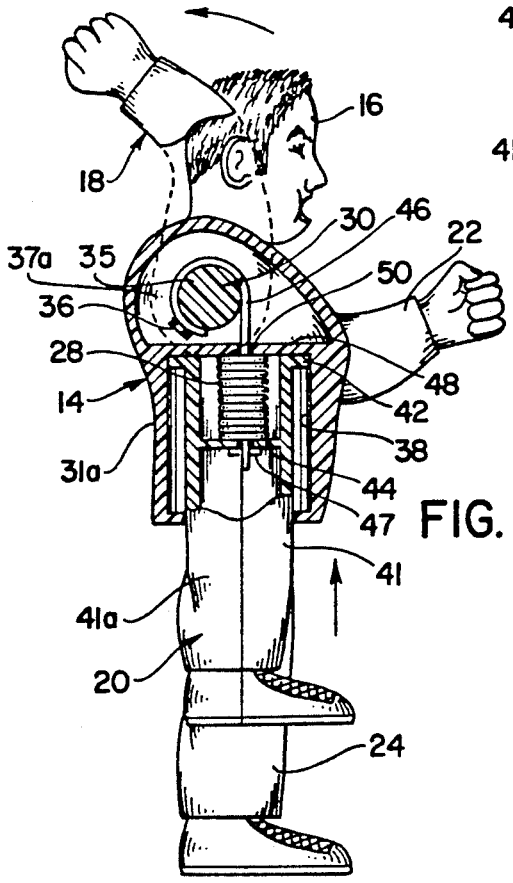
Figure 4:
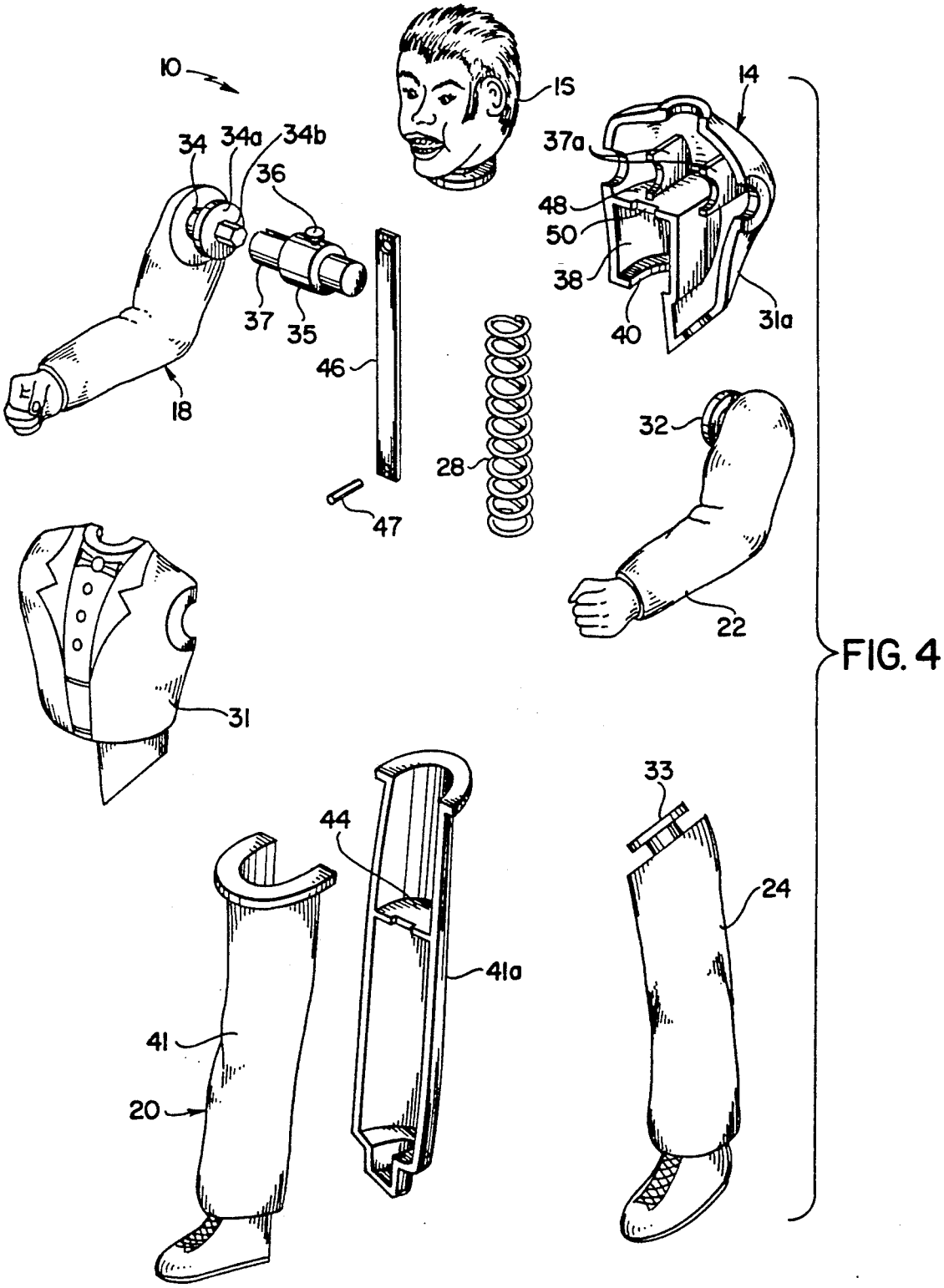
FIG. 4 is an exploded perspective view thereof.
Figure 5:
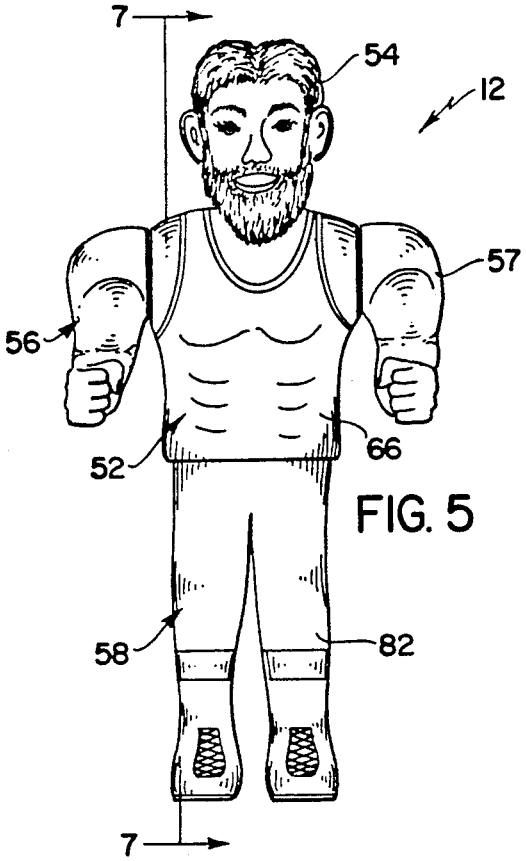
FIG. 5 is a front elevational view of a second embodiment of the character figure.
Figure 7:
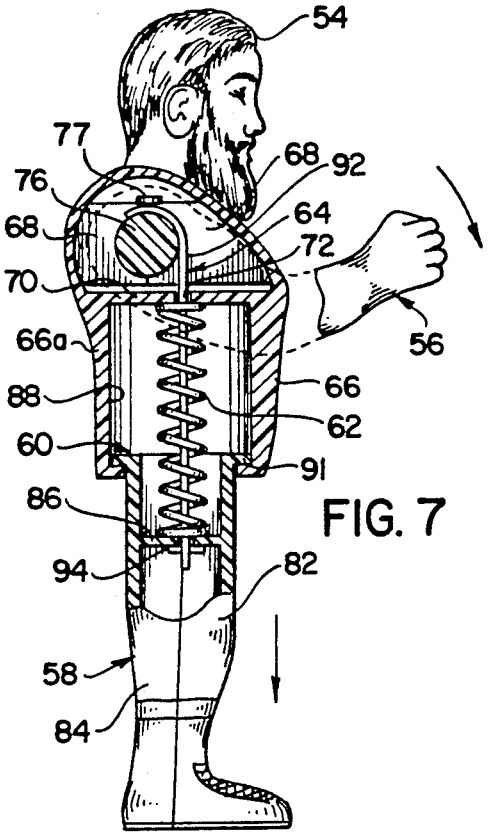
FIGS. 6 and 7 are sequential side-elevational views shown in partial section illustrating the operation of the second embodiment of the character figure.

The connecting assembly 30 includes the shaft 34, the pin 36, an interior wall 44 which is formed in the interior of the leg portion 20, and a connecting band 46. The connecting band 46 is of elongated configuration and it is formed from a suitable flexible plastic material although it could alternatively be embodied as a flexible cord or string. The band 46 is received on the pin 37, and it is secured to the interior wall 44 with a pin 47, so that it is operative for retracting the leg portion 20 upwardly into the torso portion 14 as the arm portion 18 is rotated in an upward and rearward direction as illustrated in FIG. 2. The biasing spring 28 is received on the band 46, and it extends between the wall 44 and a fixed internal wall 48 in the torso portion 14, the wall 48 having an opening 50 therein through which the band 46 passes. The spring 28 comprises a conventional coil spring, and it is operative for biasing the leg portion 20 to the downwardly extended normal position illustrated in FIGS. 1 and 3.

Accordingly, for use and operation of the action character FIG. 10, the character FIG. 10 is placed on a supporting surface, so that it is supported on the leg portion 20 and the second leg 24. In order to operate the character FIG. 10 for performing a foot-stomping action, The character FIG. 10 is held by an operator while the right arm as defined by the arm portion 18 is rotated upwardly and rearwardly to wind the band 46 on the shaft 35. As illustrated in FIG. 2, as the arm portion 18 is rotated in this manner the leg portion 20 is drawn upwardly into the 7 torso portion 14 by the band 46, so that the coil spring 28 is compressed between the walls 44 and 48. When the right arm portion 18 is then released the right arm portion 18 is rotated rapidly forwardly and downwardly in a downward punching action, and the leg portion 20 is propelled rapidly downwardly to simulate a foot-stomping action.

The character FIG. 12 is illustrated in FIGS. 5 through 8 and it comprises a torso portion generally indicated at 52 having a head 54 thereon, an arm portion generally indicated at 56, a left arm 57, a leg portion generally indicated at 58, a leg portion mounting assembly generally indicated at 60, a coil spring 62 and a connecting assembly generally indicated at 64. The action character FIG. 12 is operative by rotating the arm portion 56 upwardly and rearwardly to retract the leg portion 58 upwardly into the torso portion 52. By thereafter releasing the arm portion 56, the arm portion 56 is rotated forwardly and downwardly, and the leg portion 58 is propelled downwardly to the downwardly extended normal position illustrated in FIGS. 5 and 7.

The torso portion 52 is formed in the configuration of a human torso and it includes front and rear halves 66 and 66a, respectively. A pair of notched vertical support walls 68 is formed in each of the halves 66 and 66a, and a a horizontal partition 70 having an opening 72 therein is also formed in each of the halves 66 and 66a. The left arm 57 is rotatably mounted on the torso portion 52 by means of a conventional integrally formed rotatable disk 74, and the arm portion 56 is also rotatably mounted on the torso portion 52. However, the arm portion 56 is integrally formed with a shaft 75 having a circular disk 75a thereon, and a hex shaft 75b extends inwardly into the torso portion 14 from the disk 75a. An internal shaft 76 having a pin 77 thereon and having a slotted hex socket 78 at one end thereof is received in the interior of the torso portion 52, and the hex shaft 75b is received in the hex socket 78 so that the shaft 75b is rotatable in the socket 78 to prevent breakage in the event that an excessive rotational force is applied to the arm 56. The shaft 75b is rotatably received in the notches in the vertical support walls 68 for rotatably mounting the shaft in the torso portion 52. The leg portion 58 includes front and rear halves 82 and 84, respectively, and an inner wall 86 is formed in the interior of each of the halves 82 and 84. The mounting assembly 60 comprises a chamber 88 which is integrally formed in the interior of the torso portion 52 and has a reduced mouth 90 which is located at the lower end of the torso portion 52. The mounting assembly 60 further includes a flange 91 which is formed at the upper end of the leg portion 58 for retaining the leg portion 58 on the lower end of the torso portion 52. The leg portion 58 is mounted by means of the mounting assembly 60 so that it is retractable from the normal position thereof illustrated in FIGS. 5 and 7 to the retracted position illustrated in FIG. 6, wherein the flange 91 and the upper portion of the leg portion 58 are received in the chamber 88.

The connecting assembly 64 comprises the shaft 76, the pin 77, a flexible band 92 and a pin 94. The band 92 is received on the pin 77, and it extends through the opening 72 in the partition 70 and through a similar opening 7 in the partition 86. The band 92 is constructed of a flexible plastic material, although it will be understood that various other elements, such as cords or strings, could alternatively be utilized instead of the band 92. The pin 94 passes through the band 92 beneath the partition 86 so as to secure the lower end of the band 92 to the leg portion 58. The spring 62 is received on the band 92 so that it is captured between the partition 70 and the partition 86 for biasing the leg portion 58 to the downwardly extended position thereof.

Figure 6:
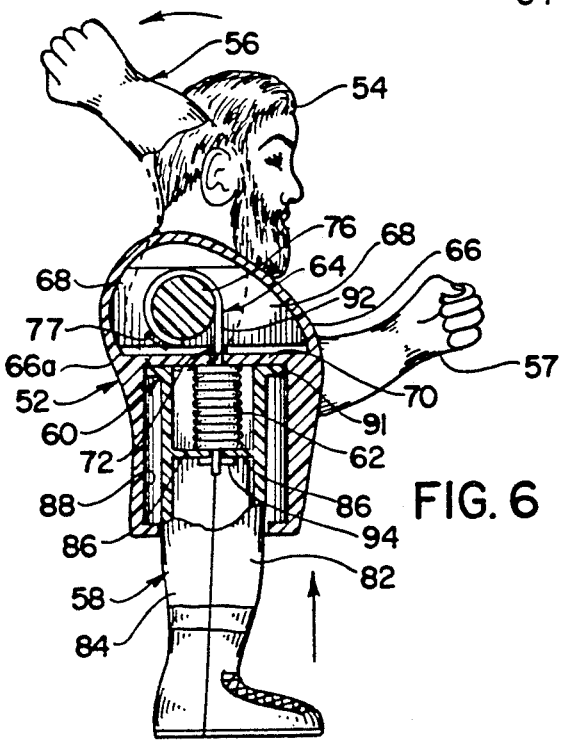
Figure 8:
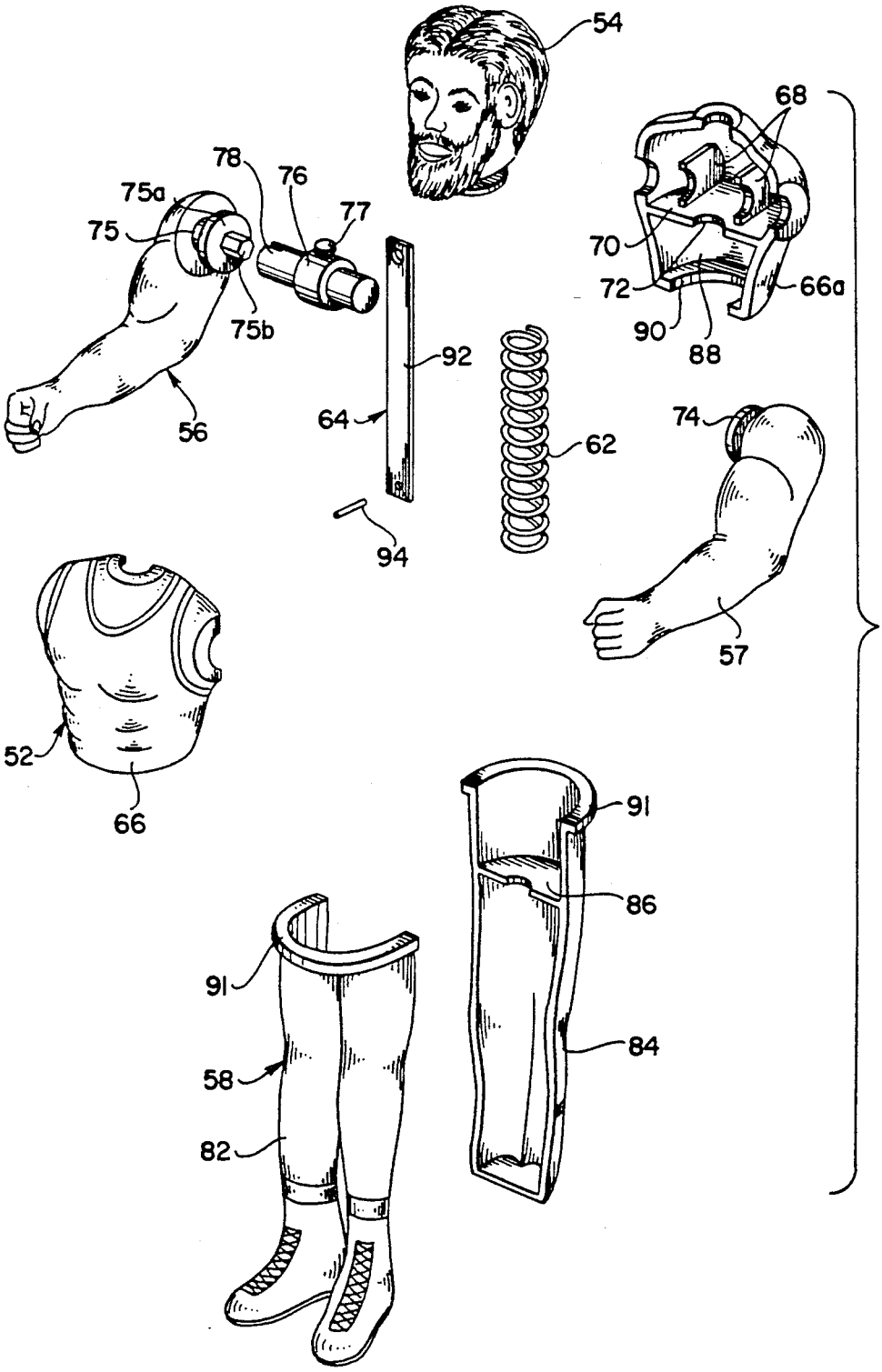
FIG. 8 is an exploded perspective view thereof.

Accordingly, for use and operation of the action character FIG. 12 the right arm portion 56 is rotated upwardly and rearwardly in the manner illustrated in FIG. 6 to coil the band 92 around the shaft 76. As the band 92 is coiled around the shaft 76, the leg portion 58 is drawn upwardly into the torso portion 52, and the spring 62 is compressed in the manner illustrated in FIG. 6. When the right arm 56 is thereafter released the right arm portion 56 is rotated forwardly and downwardly in a downward punching action, and the leg portion 58 is simultaneously propelled outwardly to the extended normal position thereof illustrated in FIGS. 5 and 7.

It is seen therefore that the instant invention provides an effective action character figure. The character FIG. 10 is operative for performing a foot-stomping action and the character FIG. 12 is operative for performing a drop-kick action. As a result, the character FIGS. 10 and 12 can be effectively utilized in various action play themes for simulating the actions of professional wrestlers as well as various other characters. Accordingly, it is seen that the instant invention represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An action character figure comprising:

a. a torso portion having a lower end;

b. at least one arm portion mounted on said torso portion so that said arm portion is rotatable about a substantially horizontal axis when said torso portion is in an upright disposition;

c. at least one leg portion;

d. means mounting said leg portion on the lower end of said torso portion so that said leg portion is movable between a normal position wherein the latter extends downwardly from said torso portion and a retracted position wherein said leg portion is at least partially retracted into said torso portion;

e. biasing means biasing said leg portion toward the normal position thereof; and f. connecting means comprising a flexible connecting element connecting said leg portion to said arm portion so that manual rotation of said arm portion in a predetermined direction causes said connecting element to wind about said axis to draw said leg portion to be retracted from said normal position thereof toward said retracted position thereof.

2. In the action character figure of claim 1, said means connecting said leg portion to said arm portion being adapted such that manual rotation of said arm portion in said predetermined direction causes said leg portion to be retracted from said normal position thereof toward said retracted position thereof and such that thereafter releasing said arm portion causes said leg portion to be returned to said normal position thereof by said biasing means.

3. In the action character figure of claim 2, said connecting means and said biasing means being adapted so that releasing said arm portion after rotating the latter in said predetermined direction causes said leg portion to be rapidly propelled toward said normal position thereof.

4. In the action character figure of claim 1, said leg portion comprising a pair of legs, both of said legs moving together between said retracted and normal positions.

5. In the action character figure of claim 1, said leg portion defining a first leg, said action character figure further comprising a second leg attached to said body portion.

6. In the action character figure of claim 1, said arm portion defining a single arm.

7. In the action character figure of claim 2, said connecting means comprising a shaft, said shaft rotating with said arm portion for winding said connecting element thereon to retract said leg portion when said arm portion is rotated in said predetermined direction.

* * * * *